US007845771B2

(12) United States Patent
Koizumi

(10) Patent No.: US 7,845,771 B2
(45) Date of Patent: Dec. 7, 2010

(54) DROPLET JET HEAD AND DROPLET JET APPLICATOR

(75) Inventor: Hiroshi Koizumi, Hiratsuka (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 778 days.

(21) Appl. No.: 11/770,275

(22) Filed: Jun. 28, 2007

(65) Prior Publication Data

US 2008/0049076 A1 Feb. 28, 2008

(30) Foreign Application Priority Data

Jun. 30, 2006 (JP) ..... P2006-182255

(51) Int. Cl.
*B41J 2/045* (2006.01)

(52) U.S. Cl. ..... 347/71

(58) Field of Classification Search ..... 347/68, 347/70–72

See application file for complete search history.

(56) References Cited

U.S. PATENT DOCUMENTS

2005/0212866 A1* 9/2005 Furuya et al. ..... 347/70
2010/0112734 A1 5/2010 Koizumi et al.

FOREIGN PATENT DOCUMENTS

JP 55-42862 3/1980
JP 2005-270743 10/2005

* cited by examiner

*Primary Examiner*—An H Do
(74) *Attorney, Agent, or Firm*—Oblon, Spivak, McClelland, Maier & Neustadt, L.L.P.

(57) ABSTRACT

A droplet jet head includes: a base member holding a plurality of piezoelectric elements; a vibration plate provided on the base member and vibrated by each of the plurality of piezoelectric elements; a liquid chamber plate provided on the vibration plate and forming wall surfaces of a plurality of liquid chambers containing liquid; a nozzle plate provided on the liquid chamber plate and having a plurality of nozzles communicating with the plurality of liquid chambers, respectively; a holder plate provided on the liquid chamber plate in a manner of covering the nozzle plate and having an opening which exposes each of the plurality of nozzles; a buffer member provided between the holder plate and the nozzle plate; and a plurality of screws fastening the base member, the vibration plate, the liquid chamber plate and the holder plate.

6 Claims, 6 Drawing Sheets

DROPLET JET HEAD AND DROPLET JET APPLICATOR

CROSS REFERENCE OF THE RELATED APPLICATION

This application is based on and claims the benefit of priority from the prior Japanese Patent Application No. 2006-182255, filed on Jun. 30, 2006; the entire content of which are incorporated herein by reference.

BACKGROUND OF THE INVENTION

1. Field of the Invention

The present invention relates to a droplet jet head that ejects droplets, and to a droplet jet applicator having the droplet jet head.

2. Description of the Related Art

A droplet jet head is a droplet jet unit (for example, an inkjet head) that ejects liquid including ink as a droplet from each of a plurality of nozzles, aiming the liquid at an application target. A droplet jet applicator having the droplet jet head is generally used for manufacturing various display devices such as a liquid crystal display device, an organic electroluminescence (EL) display device, an electron emission display device, a plasma display device and an electrophoretic display device. This droplet jet applicator causes droplets to land on a substrate being an application target by use of the droplet jet head, thus forming a dot line with a predetermined pattern. Consequently, the droplet jet applicator manufactures a coated body, for example, a color filter and a black matrix (a frame of a color filter).

Such a droplet jet head includes a base member, a vibration plate, a liquid chamber plate and a nozzle plate. The base member holds a plurality of piezoelectric elements. The vibration plate is provided on the base member and is vibrated by each piezoelectric element. The liquid chamber plate is provided on the vibration plate and has liquid chambers containing liquid. The nozzle plate is provided on the liquid chamber plate and has a plurality of nozzles communicating with the liquid chambers, respectively (refer to JP-A No. 2005-270743 (KOKAI), for example). The nozzle plate is formed of a material such as glass. The base member, the vibration plate, the liquid chamber plate and the nozzle plate are fastened by a plurality of screws each of which penetrates through the base member and these plates. The stronger the fastening force is, the more stable the jet performance of the droplet jet head becomes.

However, if the fastening force of screwing is too strong, a crack appears in the nozzle plate, since the nozzle plate is formed of a material such as glass, and also the screws press the nozzle plate directly. For this reason, the fastening force of screwing is set to have a strength in such a degree that the nozzle plate is not to be damaged. Thus, energy from the piezoelectric elements is not conveyed to the nozzle efficiently. This makes the jet performance unstable, and thereby landing accuracy of droplets lower.

SUMMERY OF THE INVENTION

An object of the present invention is to provide a droplet jet head and a droplet jet applicator, which can achieve the stabilization of jet performance and improve landing accuracy of droplets.

A first aspect according to embodiments of the present invention is to include, in the droplet jet head, a base member, a vibration plate, a liquid chamber plate, a nozzle plate, a holder plate, a buffer member and a plurality of screws. The base member holds a plurality of piezoelectric elements. The vibration plate is provided on the base member and is vibrated by the plurality of piezoelectric elements. The liquid chamber plate is provided on the vibration plate and forms wall surfaces of a plurality of liquid chambers containing liquid, and the capacities of the liquid chambers are changed by the vibration plate. The nozzle plate is provided on the liquid chamber plate and has a plurality of nozzles communicating with the plurality of liquid chambers, respectively. The holder plate is provided on the liquid chamber plate in a manner of covering the nozzle plate and has an opening exposing the plurality of nozzles. The buffer member is provided between the holder plate and the nozzle plate. The plurality of screws fasten the base member, the vibration plate, the liquid chamber plate and the holder plate.

A second aspect according to the embodiments of the present invention is to include, in the droplet jet applicator, the droplet jet head with the above-mentioned first character, and a main body which supplies ink to the droplet jet head as well as holds the droplet jet head.

DETAILED DESCRIPTION OF THE PREFERRED EMBODIMENTS

First Embodiment

Descriptions of a first embodiment of the present invention will be given with reference to FIGS. 1 to 3.

Figure 1:
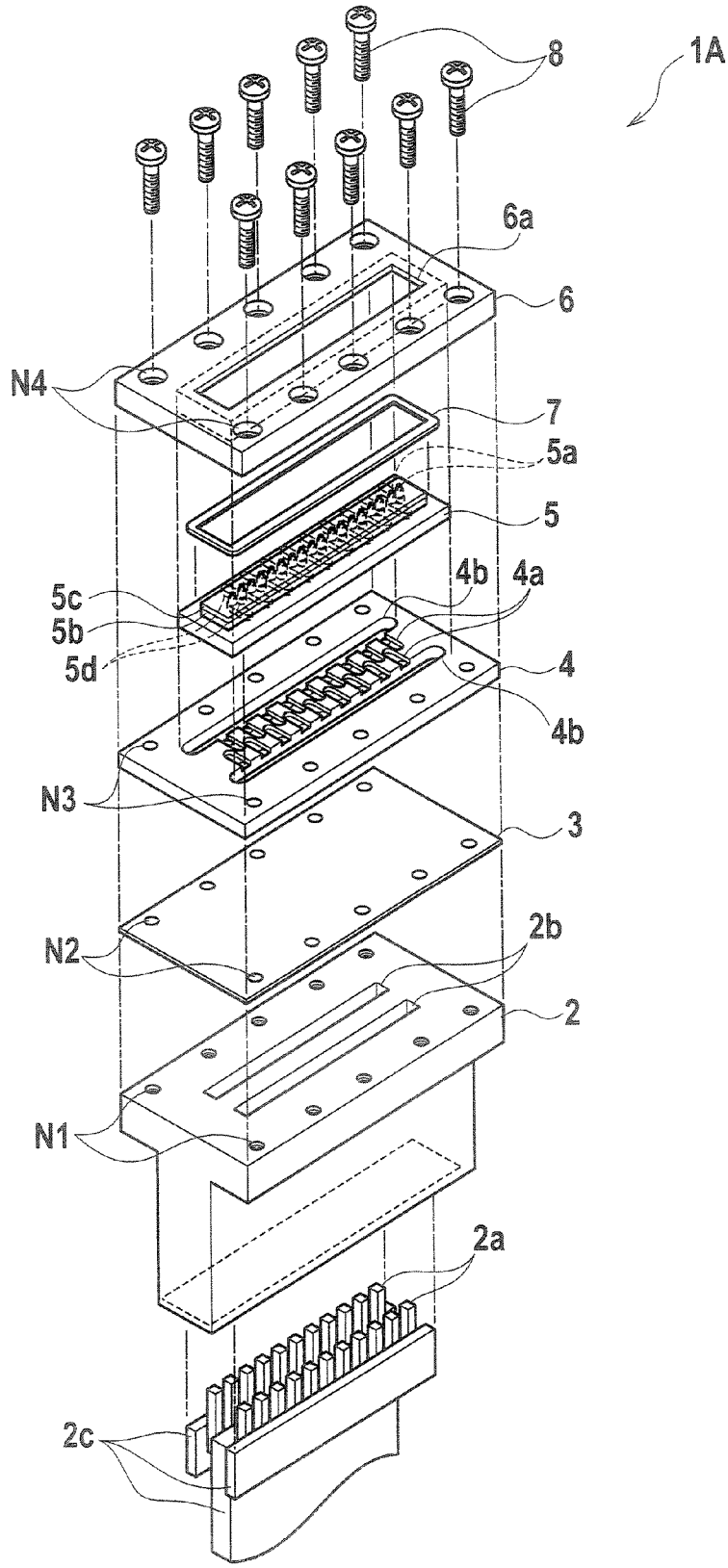
FIG. 1 is an exploded perspective view showing a schematic configuration of a droplet jet head according to a first embodiment of the present invention.
Figure 2:
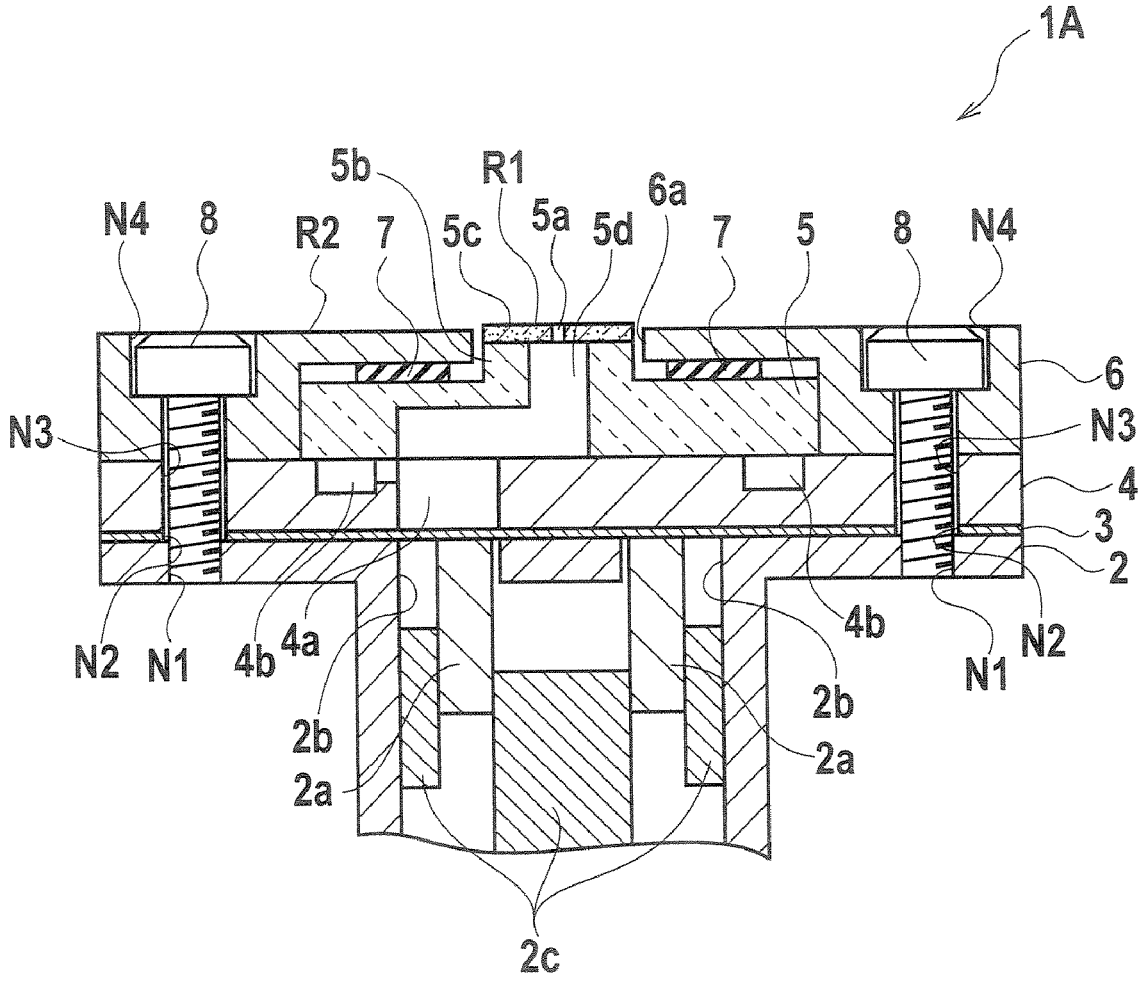
FIG. 2 is a sectional view showing the schematic configuration of the droplet jet head shown in FIG. 1.

As shown in FIGS. 1 and 2, a droplet jet head 1A according to the first embodiment of the present invention includes a base member 2, a vibration plate (a diaphragm plate) 3, a liquid chamber plate 4, a nozzle plate 5, a holder plate 6, a buffer member 7 and a plurality of screws 8. The base member 2 holds a plurality of piezoelectric elements 2*a*. The vibration plate 3 is provided on the base member 2 and is vibrated by each of the piezoelectric elements 2*a*. The liquid chamber plate 4 is provided on the vibration plate 3 and forms wall surfaces of a plurality of liquid chambers 4*a* containing liquid, such as ink, and the capacities of the liquid chambers are changed by the vibration plate 3. The nozzle plate 5 is provided on the liquid chamber plate 4 and has a plurality of nozzles 5*a* communicating with the plurality of liquid chambers 4*a*, respectively. The holder plate 6 is provided on the liquid chamber plate 4 in a manner of covering the nozzle plate 5, and has an opening 6*a* exposing each of the plurality of nozzles 5*a*. The buffer member 7 is provided between the holder plate 6 and the nozzle plate 5. The plurality of screws 8 fasten the base member 2, the vibration plate 3, the liquid chamber plate 4 and the holder plate 6.

The base member 2 is formed of metal materials such as stainless. On the surface of the base member 2, two insertion openings 2*b*, into which each of the piezoelectric elements 2*a* are inserted, and a plurality of screw holes N1 into which the screws 8 are respectively inserted. Each of the insertion openings 2*b* is shaped into, for example, a rectangular form, and is provided approximately in the center of the surface of the base member 2. In addition, each screw hole N1 is provided on the periphery of the surface of the base member 2. A groove of a female screw, for example, is formed inside the screw holes N1. It should be noted that the number of the screw holes N1 provided is ten, for example.

The piezoelectric elements 2*a* are arranged in two parallel rows, and are supported by three supporting members 2*c*, for example. These piezoelectric elements 2*a* are inserted into each of the insertion openings 2*b* such that the respective points are in contact with the vibration plate 3, and are provided inside the base member 2 together with the three supporting members 2*c*. Incidentally, the point of each piezoelectric element 2*a* is adhered and fixed to the vibration plate 3. This type of piezoelectric elements 2*a* are connected with wires for applying voltage. If voltage is applied to each of the piezoelectric elements 2*a*, the vibration plate 3 is vibrated by the expansion and contraction of each piezoelectric element 2*a*.

The vibration plate 3 is formed of an elastic material, for example. A plurality of screw holes N2 into which the screws 8 are inserted, respectively, are formed in the vibration plate 3. Each of these screw holes N2 is provided on the periphery of the surface of the vibration plate 3, and is a through-hole which penetrates the vibration plate 3. Incidentally, ten screw holes N2 are provided, for example, and are formed by being positioned on the same line as the screwholes N1. The vibration plate 3 alters its shape due to the expansion and contraction of each piezoelectric element 2*a*, and, accordingly, the capacities of the liquid chambers 4*a* of the liquid chamber plate 4 are increased or decreased Consequently, the liquid in each of the liquid chamber 4*a* is caused to jet from each nozzle 5*a* as droplets.

The liquid chamber plate 4 is formed of materials such as metal and ceramic. In the liquid chamber plate 4, formed are the liquid chambers 4*a*, each of which contains liquid, two liquid supply slots 4*b*, which communicate with these liquid chambers 4*a*, and a plurality of screw holes N3, into which the screws 8 are inserted, respectively. The respective liquid chambers 4*a* are containers which contain liquid supplied from the liquid supply slots 4*b*, and are provided in two parallel rows approximately in the center of the liquid chamber plate 4. The bottom surfaces of these liquid chambers 4*a* are formed by the vibration plate 3. The respective liquid supply slots 4*b* are provided approximately in parallel to each other in a manner of holding each of the liquid chambers 4*a*. Liquid is supplied to these liquid supply slots 4*b* from an external liquid tank or the like through supply paths (not illustrated) such as tubes. Each of the screw holes N3 is provided on the periphery of the surface of the liquid plate 4, and is a through-hole which penetrates the liquid chamber plate 4. It should be noted that ten screw holes N3 are provided, for example, and are formed by being positioned on the same line as the screw holes N1.

The nozzle plate 5 is formed of a material such as glass, by use of a micromachining technology for a semiconductor such as Micro ElectroMechanical Systems (MEMS) technology. The nozzle plate 5 is formed in a manner of protruding from the opening 6*a* of the holder plate 6. In other words, the nozzle plate 5 is provided with a salient 5*b* which is inserted into the opening 6*a* of the holder plate 6. As a result, an exposure R1 of the nozzle plate 5 (an exposure of an orifice plate 5*c*) protrudes approximately several ten μm, for example, compared with a surface R2 of the holder plate 6, as shown in FIG. 2. On the surface of the salient 5*b* (on the top surface in FIG. 2), the orifice plate 5*c*, where the respective nozzles 5*a* are formed in a row, is provided. The orifice plate 5*c* is formed of a material such as silicon (Si). Furthermore, the nozzle plate 5 is provided with a plurality of fluid channels 5*d* by which the liquid chambers 4*a* and the nozzles 5*a* are communicated, respectively. These fluid channels 5*d* are formed by facing the liquid chambers 4*a*, respectively.

The holder plate 6 is formed of a material, such as metal, whose compressive strength is greater than that of the nozzle plate 5. The opening 6*a*, formed such that each of the nozzles 5*a* is exposed, and a plurality of screw holes N4, into which the screws 8 are inserted respectively, are formed in the holder plate 6. The opening 6*a* is provided approximately in the center of the holder plate 6, and is shaped into a form to expose each nozzle 5*a*, for example, a rectangular form. Each nozzle 5*a* of the nozzle plate 6 is exposed from the opening 6*a*. Moreover, each screw hole N4 is provided on the periphery of the surface of the holder plate 6, and is a through-hole which penetrates the holder plate 6. These screw holes N4 are formed by, for example, countersunk hole processing. It should be noted that ten screw holes N4 are provided, for example, and are formed by being positioned on the same line as the screw holes N1.

The buffer member 7 is shaped into a circular form, for example, and is provided in the circumference of the salient 5*b* of the nozzle plate 5. The buffer member 7 prevents the nozzle plate 5 and the holder plate 6 from contacting each other directly, and lessens impacts of the contact thereof. An elastic member is used for the buffer member 7, for example. Polytetrafluoroethylene (PTFE), silicon, kalrez, and the like are used as a material of the elastic member.

Each screw 8 is shaped into a cylinder form, for example, and is inserted into each of the screw holes N1, N2, N3 and N4. These screws 8 fix the vibration plate 3, the liquid chamber plate 4 and the holder plate 6 to the base member 2. At this point, the nozzle plate 5 is also held between the holder plate 6 and the liquid chamber plate 4, thus being fixed. The groove of a female screw, for example, is formed for each of the screws 8. The base member 2, the vibration plate 3, the liquid chamber plate 4 and the holder plate 6 are fastened by this type of respective screws 8.

Next, descriptions of jet behavior of this type of droplet jet head 1A will be given.

If voltage is applied to each of the piezoelectric elements 2*a* (application voltage ON), each of the piezoelectric elements 2*a* is contracted, thus altering the shape of the vibration plate 3. Consequently, the capacities of the corresponding liquid chambers 4*a* are increased. At this point, liquid is filled in the liquid chambers 4*a* whose capacities have been increased, from the liquid supply slots 4*b*. When voltage is stopped to be applied to each of the piezoelectric elements 2*a* (application voltage OFF), the vibration plate 3 is restored to the original shape, and the capacities of the corresponding liquid chambers 4*a* are restored to the original ones. At this point, the liquid in the liquid chambers 4*a* is compressed, and the liquid is ejected as droplets from the nozzles 5*a*.

As described above, according to the first embodiment of the present invention, the holder plate 6 is provided in a manner of covering the nozzle plate 5, and the buffer member 7 is provided between the nozzle plate 5 and the holder plate 6. This causes each screw 8 to contact with the holder plate 6 and not to press the nozzle plate 5 directly. In addition, the nozzle plate 5 is also prevented contacting with the holder plate 6. Thus, it is possible to improve the fastening force of each screw 8 while preventing the nozzle plate 5 from being damaged. In this manner, a sufficient fastening force can be obtained. As a result, it is possible to realize the stabilization of jet performance and to improve landing accuracy of droplets. Furthermore, since the sufficient fastening force can be obtained, it is possible to securely prevent liquid from leaking out from between the vibration plate 3, and the liquid chamber plate 4 as well as between the liquid chamber plate 4 and the nozzle plate 5. Moreover, since the nozzle plate 5 is covered by the holder plate 6, the mechanical strength of the droplet jet head 1A can be improved. As a result, it is possible to prevent the droplet jet head 1A from being damaged.

In addition, the nozzle plate 5 is formed such that an area where the nozzles 5*a* are formed protrudes from the opening 6*a* of the holder plate 6 in a state where the nozzle plate 5 is joined with the holder plate 6. Hence, the exposure R1 of the nozzle plate 5 (the exposure of the orifice plate 5*c*) protrudes compared with the surface R2 of the holder plate 6. With this, when a head cleaning operation in which each nozzle 5*a* and the periphery thereof, and the like are performed, it is easy to clean each nozzle 5*a* and the periphery thereof, thereby allowing these to be cleaned surely. Consequently, it is possible to prevent the occurrence of a failure in ejecting a droplet.

Furthermore, the holder plate 6 is formed of a material which produces a compressive strength greater than that of the nozzle plate 5. Thus, the mechanical strength of the holder plate 6 is improved compared with that of the nozzle plate 5. Consequently, compared with a case where the holder plate 6 and the nozzle plate 5 are formed of the same material, it is possible to increase the fastening force of each screw 8 while preventing the holder plate 6 from getting damaged, and moreover, the nozzle plate 5 can be protected from a stronger impact.

Figure 3:
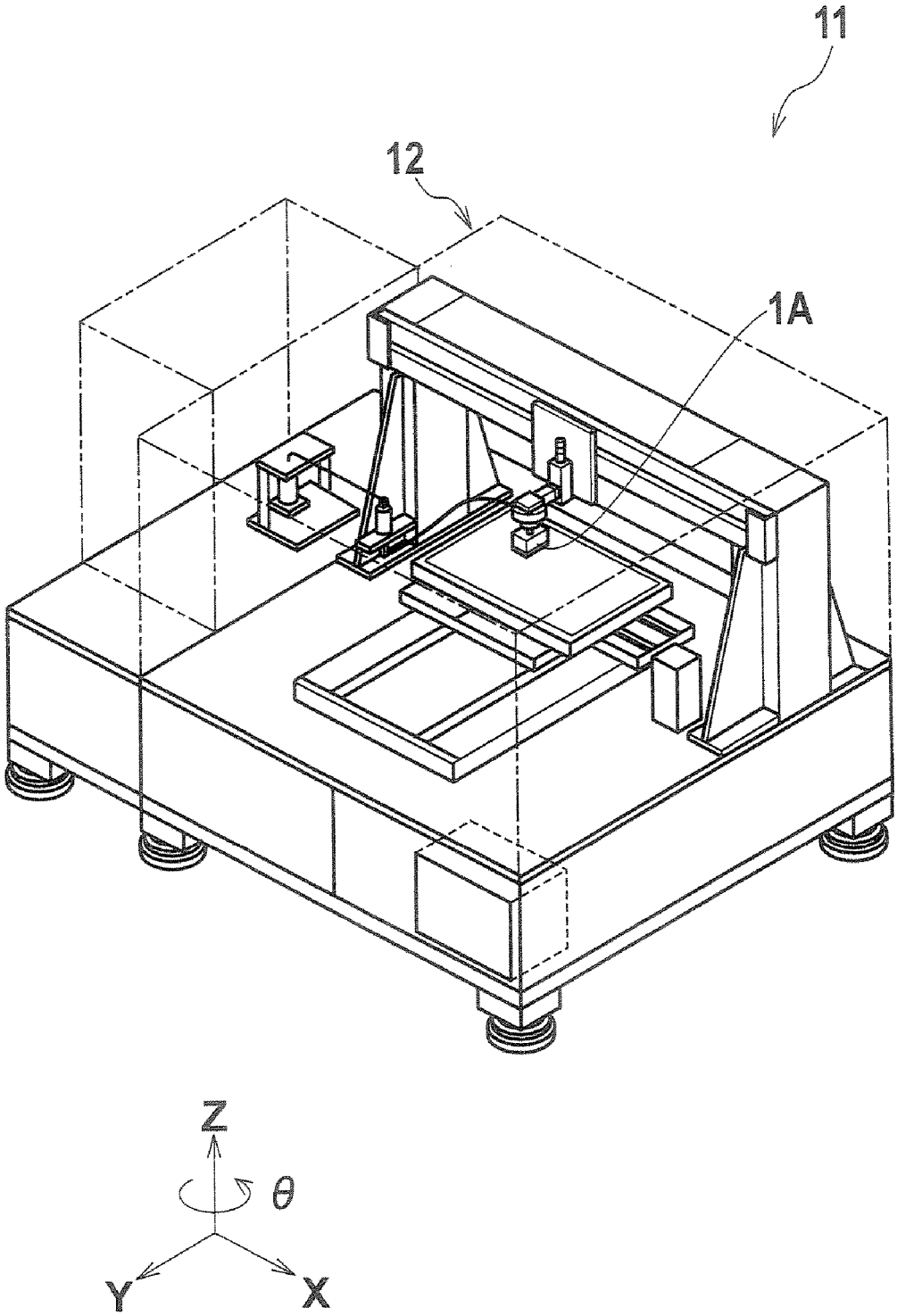
FIG. 3 is a perspective view showing a schematic configuration of a droplet jet applicator has the droplet jet head shown in FIG. 1 and FIG. 2.

Incidentally, it is possible to realize the stabilization of jet performance and improve landing accuracy of droplets, by configuring a droplet jet applicator 11 by use of this type of droplet jet head 1A and a main body 12 which holds the droplet jet head 1A as well as supplies ink to the droplet jet head 1A, as shown in FIG. 3. Furthermore, since the droplet jet head 1A has a great mechanical strength, the durability of the droplet jet applicator can be improved.

Second Embodiment

Descriptions of a second embodiment of the present invention will be given with reference to FIG. 4. In the second embodiment of present invention, descriptions will be given with respect to parts which are different from the first embodiment. It should be noted that in the second embodiment, the parts that are same with the ones described in the first embodiment are shown with the same symbols, and the descriptions thereof will be omitted (this will be applied to other embodiments).

Figure 4:
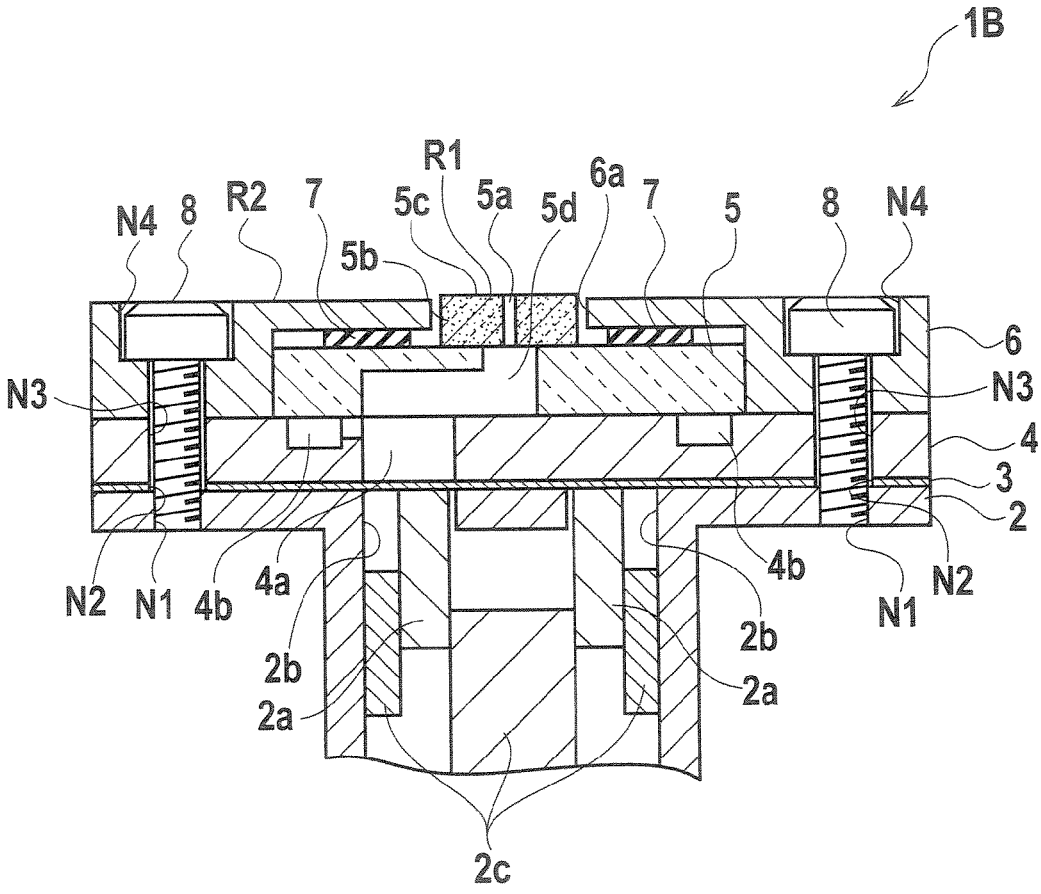
FIG. 4 is a sectional view showing a schematic configuration of a droplet jet head according to a second embodiment of the present invention.

As shown in FIG. 4, the salient 5*b* of the nozzle plate 5 is formed by the orifice plate 5*c* in a droplet jet head 1B according to the second embodiment of the present invention, and the nozzle plate 5 is shaped in a rectangular-parallelepiped form. The orifice plate 5*c* is formed such that the exposure R1 of the nozzle plate 5 (the exposure of the orifice plate 5*c*) protrudes approximately several ten μm, for example, compared with the surface R2 of the holder plate 6.

As described above, according to the second embodiment of the present invention, it is possible to obtain the same effects as those of the first embodiment. Especially, it is sufficient if the nozzle plate 5 is shaped into a rectangular-parallelepiped form, which makes it easy to process the nozzle plate 5. Thus, it is possible to suppress a decrease in the yield when manufacturing the droplet jet head 1B.

Third Embodiment

Descriptions of a third embodiment of the present invention will be given with reference to FIG. 5. In the third embodiment of the present invention, descriptions will be given with respect to parts which are different from the first embodiment.

Figure 5:
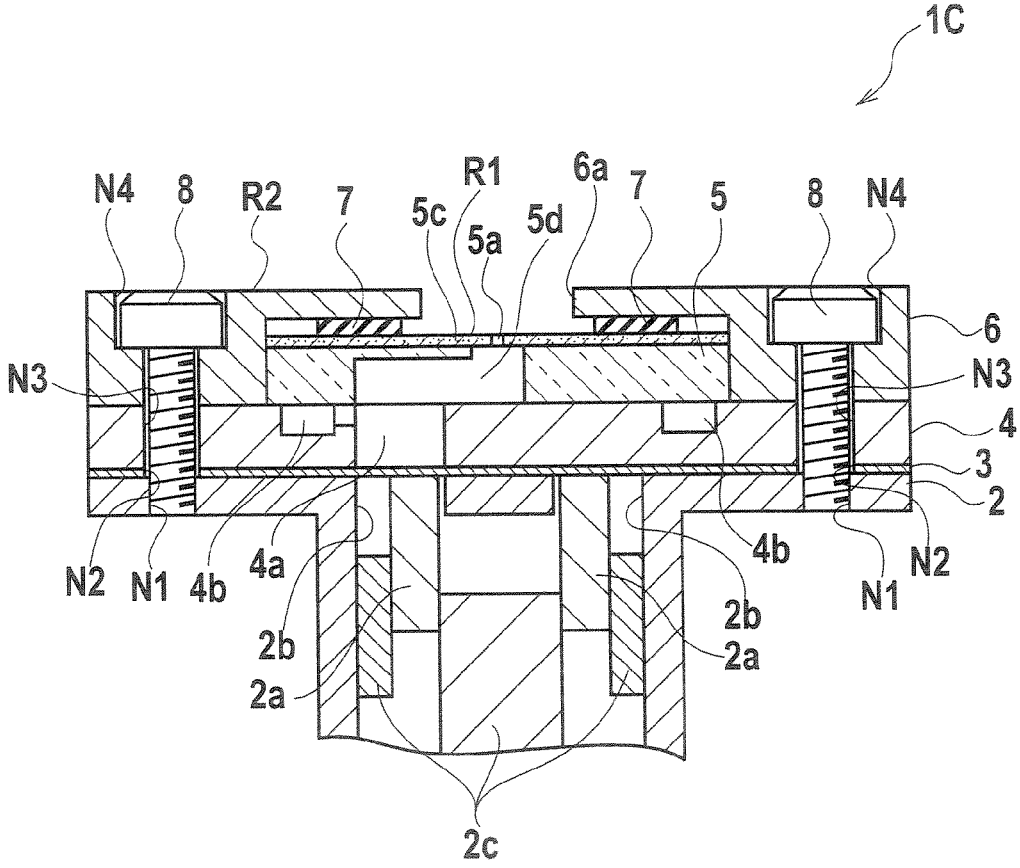
FIG. 5 is a sectional view showing a schematic configuration of a droplet jet head according to a third embodiment of the present invention.

As shown in FIG. 5, the salient 5*b* of the nozzle plate 5 is not formed in a droplet jet head 1C according to the third embodiment of the present invention, and the nozzle plate 5 is shaped into a rectangular-parallelepiped form. The orifice plate 5*c* is provided all over the surface of the nozzle plate 5.

As described above, according to the third embodiment of the present invention, it is possible to obtain the same effects as those of the first embodiment. Especially, it is sufficient if the nozzle plate 5 is shaped into a cuboid form, which makes it easy to process the nozzle plate 5. Thus, it is possible to suppress a decrease in the yield when manufacturing the droplet jet head 1C. However, since the exposure R1 of the nozzle plate 5 (the exposure of the orifice plate 5*c*) does not protrude, compared with the surface R2 of the holder plate 6, the cleaning becomes less easy than the first embodiment.

Fourth Embodiment

Descriptions of a fourth embodiment of the present invention will be given with reference to FIG. 6. In the fourth embodiment of the present invention, descriptions will be given with respect to parts which are different from the first embodiment.

Figure 6:
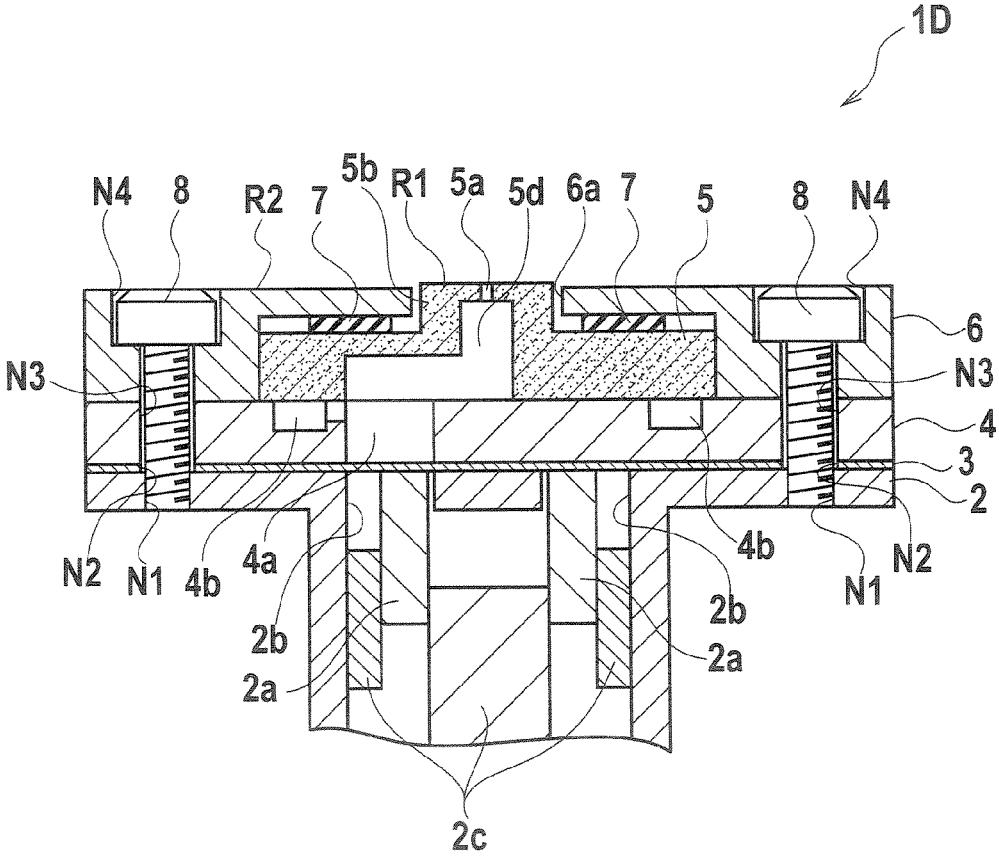
FIG. 6 is a sectional view showing a schematic configuration of a droplet jet head according to a fourth embodiment of the present invention.

As shown in FIG. 6, the orifice plate 5*c* is not provided in a droplet jet head 1D according to the fourth embodiment of the present invention, and each nozzle 5*a* is formed in a row at the salient 5*b* of the nozzle plate 5. Incidentally, the exposure R1 of the nozzle plate 5 is formed in a manner of protruding approximately several ten μm, for example, compared with the surface R2 of the holder plate 6.

As described above, according to the fourth embodiment of the present invention, it is possible to obtain the same effects as those of the first embodiment. Especially, it is made unnecessary to provide the orifice plate 5*c* on the nozzle plate 5, which makes it possible to decrease the number of manufacturing steps. Thus, it is possible to suppress a decrease in the yield when manufacturing the droplet jet head 1D.

Other Embodiments

It should be noted that the present invention is not limited to the above-mentioned embodiments, and various alterations can be made therein within the scope and spirit of the present invention.

For example, although the vibration plate 3 is fixed by the screws 8 between the base member 2 and the liquid chamber plate 4 in the above-mentioned embodiments, the fixing method is not limited to this. For example, the vibration plate 3 may be adhered and fixed by an adhesive in addition to the screws 8, between the base member 2 and the liquid chamber plate 4.

Moreover, although one buffer member 7, which is shaped into a circular form, is provided on the nozzle plate 5 in the above-mentioned embodiments, it is not limited to this. For example, the buffer member 7 may be shaped into a rectangular or disc form, and the plurality of buffer members 7 may be provided on the nozzle plate 5.

Lastly, although the grooves of the female screws are not formed inside the screw holes N4 in the above-mentioned embodiments, it is not limited to this. For example, the grooves of the female screws may be formed inside the screw holes N4.

What is claimed is:

1. A droplet jet head comprising:

a base member which holds a plurality of piezoelectric elements;

a vibration plate which is provided on the base member and vibrated by the plurality of piezoelectric elements;

a liquid chamber plate which is provided on the vibration plate, and which forms wall surfaces of a plurality of liquid chambers containing liquid, the capacities of the liquid chambers being changed by the vibration plate;

a nozzle plate which is provided on the liquid chamber plate, and which has a plurality of nozzles communicating with the plurality of liquid chambers, respectively;

a holder plate which is provided on the liquid chamber plate in a manner of covering the nozzle plate, and which has an opening exposing the plurality of nozzles;

a buffer member which is provided between the holder plate and the nozzle plate; and a plurality of screws which fasten the base member, the vibration plate, the liquid chamber plate and the holder plate, wherein the nozzle plate is formed such that an area where the nozzles are formed protrudes from the opening in a state where the nozzle plate is joined with the holder plate.

2. The droplet jet head according to claim 1, wherein the holder plate is formed of a material which produces a compressive strength greater than that of the nozzle plate.

3. The droplet jet head according to claim 1, wherein the nozzle plate includes an orifice plate where the plurality of nozzles are formed.

4. A droplet jet applicator comprising:

a droplet jet head; and a main body which holds the droplet jet head as well as supplies ink to the droplet jet head, wherein the droplet jet head includes:

a base member which holds a plurality of piezoelectric elements;

a vibration plate which is provided on the base member and vibrated by the plurality of piezoelectric elements;

a liquid chamber plate which is provided on the vibration plate, and which forms wall surfaces of a plurality of liquid chambers containing liquid, the capacities of the liquid chambers being changed by the vibration plate;

a nozzle plate which is provided on the liquid chamber plate, and which has a plurality of nozzles communicating with the plurality of liquid chambers, respectively;

a holder plate which is provided on the liquid chamber plate in a manner of covering the nozzle plate, and which has an opening exposing the plurality of nozzles;

a buffer member which is provided between the holder plate and the nozzle plate; and a plurality of screws which fasten the base member, the vibration plate, the liquid chamber plate and the holder plate, wherein the nozzle plate is formed such that an area where the nozzles are formed protrudes from the opening in a state where the nozzle plate is joined with the holder plate.

5. The droplet jet applicator according to claim 4, wherein the holder plate is formed of a material which produces a compressive strength greater than that of the nozzle plate.

6. The droplet jet applicator according to claim 4, wherein the nozzle plate includes an orifice plate where the plurality of nozzles are formed.

* * * * *